US006311454B1

(12) United States Patent
Kempel

(10) Patent No.: US 6,311,454 B1
(45) Date of Patent: Nov. 6, 2001

(54) DOOR CONSTRUCTION

(75) Inventor: John J. Kempel, West Branch, MI (US)

(73) Assignee: Globe Door, L.L.C., Standish, MI (US)

( * ) Notice: Subject to any disclaimer, the term of this patent is extended or adjusted under 35 U.S.C. 154(b) by 0 days.

(21) Appl. No.: 09/252,394

(22) Filed: Feb. 18, 1999

(51) Int. Cl.[7] ..... E04C 2/54

(52) U.S. Cl. ..... 52/784.15; 52/784.1; 52/794.1; 52/309.11; 52/656.4; 52/656.9

(58) Field of Search ..... 52/784.1, 794.1, 52/309.11, 800.13, 656.4, 656.9

(56) References Cited

U.S. PATENT DOCUMENTS

| | | | |
|---|---|---|---|
| 1,118,265 | 11/1914 | Burbidge . | |
| 1,466,651 | 8/1923 | Peterson . | |
| 2,889,899 | 6/1959 | Bianco . | |
| 2,934,184 | 4/1960 | Moser . | |
| 3,222,833 | 12/1965 | Woodrum . | |
| 4,021,988 | 5/1977 | Edeus et al. . | |
| 4,099,815 | 7/1978 | Cox et al. . | |
| 4,193,245 | 3/1980 | Johnson . | |
| 4,303,289 | 12/1981 | Hardy . | |
| 4,327,535 * | 5/1982 | Governale | 52/309.11 |
| 5,092,063 | 3/1992 | Shultz . | |
| 5,222,335 | 6/1993 | Petrecca . | |
| 5,378,077 | 1/1995 | Paulsen . | |
| 5,557,899 | 9/1996 | Dube et al. . | |
| 5,671,580 | 9/1997 | Chou . | |
| 5,839,252 * | 11/1998 | Berghorne et al. | 52/784.13 |
| 6,024,908 * | 2/2000 | Koncelik | 52/331.11 |
| 6,068,802 * | 5/2000 | Berghorn et al. | 264/46.5 |

* cited by examiner

*Primary Examiner*—Carl D. Friedman
*Assistant Examiner*—Christy M. Syres
(74) *Attorney, Agent, or Firm*—Reising, Ethington, Barnes, Kisselle, Learman & McCulloch, P.C.

(57) ABSTRACT

A door having a plurality of channel-shaped frame members encircling a core and being coupled to one another by interfitting dimples and projections at the confronting ends of adjacent frame members. On opposite sides of the core are panels having lips which are accommodated in grooves formed in the frame members. The components of the door may be assembled without the need for any tools and such components may be maintained in assembled condition without the use of separate fastening devices such as bolts, nails, screws, and the like, or any fixtures or measuring devices.

17 Claims, 3 Drawing Sheets

DOOR CONSTRUCTION

This invention relates to a door construction and more particularly to a door having at its perimeter vertical and horizontal frame members, panels on opposite sides, and a core between the panels and spanning the space between the frame members, all of such parts being assembled and retained in assembled relation without requiring the use of any bolts, screws, or other fasteners.

BACKGROUND OF THE INVENTION

Interior and exterior doors conventionally are formed by assembling a plurality of frame members and other components which are joined and maintained assembled by various kinds of fastening devices such as bolts, screws, nails, and the like. The necessity of having to use fastening devices separate from the door components themselves is objectionable for a number of reasons. For example, an inventory of and storage facilities for such fasteners must be maintained. Fasteners needed from time to time must be removed from storage and applied manually to a door under construction. The manual application of such fastening devices inevitably results in imperfections due to differences in skills, experience, and other factors affecting the assemblers. Doors which are not uniform in manufacture cannot be uniform in use. Consequently, some doors fit better than others, have a better appearance, and provide greater trouble-free operation.

A principal object of the invention is to provide a door construction which overcomes the disadvantages referred to above.

SUMMARY OF THE INVENTION

A door constructed in accordance with the invention comprises a plurality of separate frame members which, when assembled, form a quadrangular frame of such size as to be accommodated in a doorway. Each frame member is channel-shaped and has a pair of spaced, parallel flanges joined at corresponding edges by a web. At the juncture between the web and each flange is a groove which extends the full length of the frame member. The ends of each frame member are mitered or shaped to form a substantially right-angular joint and the flange of each frame member has an extension at each end which projects beyond such flange.

The extensions are so arranged that, at each of the confronting ends of a pair of frame members, the extensions of the flanges of one of the frame members overlap the extensions on the flanges of the adjacent frame member. The overlapping flanges have cooperating dimples and projections which nest with one another and maintain the frame members assembled.

A core formed of insulating material spans the frame members and is accommodated in the channels of the frame members. The core is sandwiched between two external panels which preferably are adhesively secured to the core and to the confronting surfaces of the frame members. The marginal edge of each panel has a lip which is accommodated in the groove of each frame member and adhesively secured thereto.

If the door is one which should have a lock and/or latch mechanism associated therewith, a portion of the core may be cut away to accommodate a lock/latch mechanism support block and either or both of the panels may be provided with an opening to provide access to the lock/latch mechanism. The frame member associated with the lock/latch mechanism may be provided with an opening for accommodation of the lock and/or latch.

The panels may be flush or embossed and solid or provided with openings to accommodate one or more lights, in which case the core will be provided with a corresponding opening or openings.

THE DRAWINGS

A door constructed in accordance with the preferred embodiment of the invention is illustrated in the accompanying drawings in which.

Figure 4:
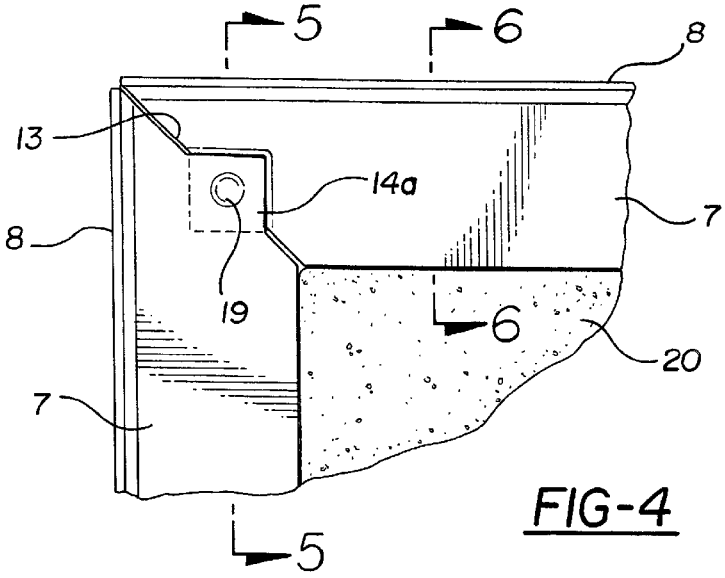
Figure 5:
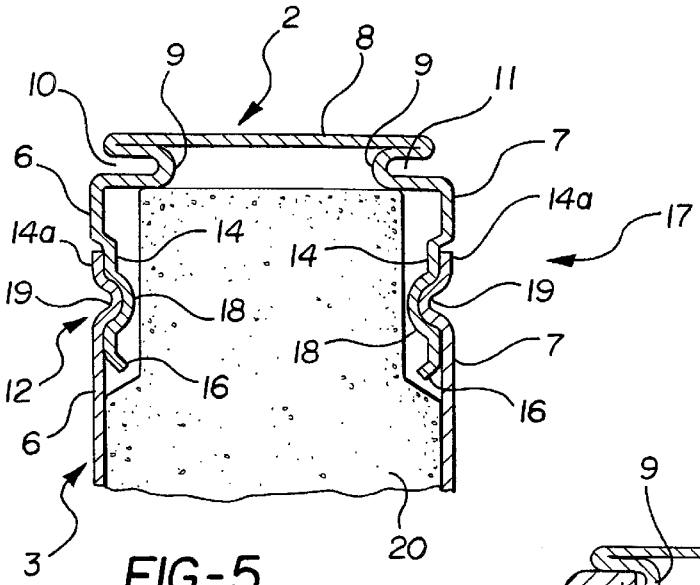
Figure 6:
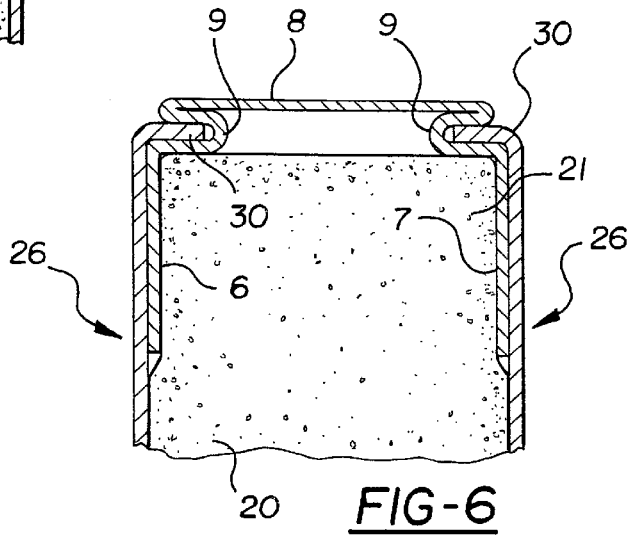

FIG. 4 is a fragmentary, elevational view showing two adjacent frame members assembled with one another and supporting a core; and FIGS. 5 and 6 are enlarged sectional views taken on the lines 5-5 and 6-6, respectively, of FIG. 4.

DETAILED DESCRIPTION

A door constructed in accordance with the invention is designated generally by the reference character 1 and comprises four separate frame members 2, 3, 4, and 5, the members 2 and 4 being parallel to but spaced apart from one another and the members 3 and 5 being parallel to and spaced apart to each other. The frame members 2-5 are arranged and joined to one another in such manner as to form a closed, quadrangular frame, the members 2 and 4 constituting cross members and the members 3 and 5 constituting stiles.

Each of the frame members 2–5 is of channel configuration having a pair of parallel flanges 6 and 7 joined by a planar web 8. At the juncture of the flanges 6 and 7 with the web 8 the flanges are reversely turned as at 9 (FIG. 5) to form grooves 10 and 11 which extend the full length of each frame member.

The free ends 12 and 13 of the flanges 6 and 7 are mitered or beveled so that when the ends of two adjacent frame members are placed together the two members extend substantially normal to one another.

Each of the flanges 6 and 7 of the frame members 2 and 4 has an extension 14 which projects beyond the mitered end of the associated flange, and each of the flanges 6 and 7 of the frame members 3 and 5 has a corresponding extension 14*a*. The extensions 14 are offset from the plane of the flanges 6 and 7 in a direction toward one another by an amount sufficient to enable the extensions 14 to be accommodated between and overlap the extensions 14*a*. See FIG. 5. Otherwise, the space between the flanges; 6 and 7 of each of the frame members is the same. The free edge of each of the extensions 14 is turned inwardly or toward one another as is indicated at 16 in FIG. 5, to facilitate nesting of the extensions.

The extensions 14 and 14*a* are provided with cooperable coupling means 17 for maintaining the frame members in assembled relation. In the preferred embodiment the coupling means comprises a substantially hemispherical dimple or depression 18 in each of the extensions 14 and a substantially hemispherical projection 19 in each of the extensions 15 which confronts the dimple in the adjacent extension so as to be accommodated therein.

The frame members may be fitted together and maintained in assembled relation without the use of any tools, fixtures or measuring devices. When assembled the frame members will be secure and maintain the correct size and squareness of the door frame.

The door construction preferably includes a core 20 having a reduced thickness marginal edge 21 of such size as freely to be accommodated between the flanges of each of the channel-shaped frame members 2–5. The core preferably is formed from an environmentally safe, CFC-free polystyrene which is self extinguishing and non-toxic when burned. The core 20 is thermally insulating and may be shaped prior to its assembly with the frame members 2–5 to fit within the channel-forming flanges 6 and 7, as well as between the extensions 14.

Figure 1:
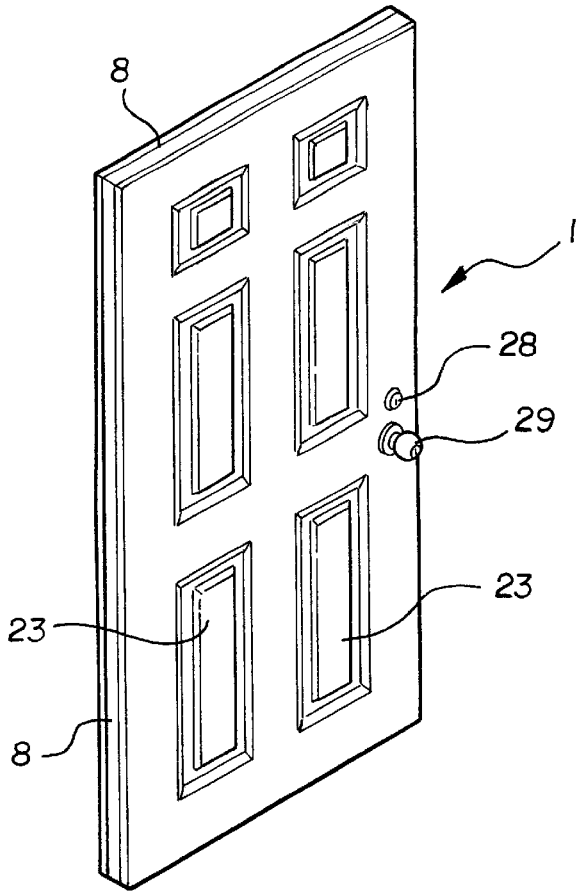
FIG. 1 is an isometric view of a finished door.
Figure 3:
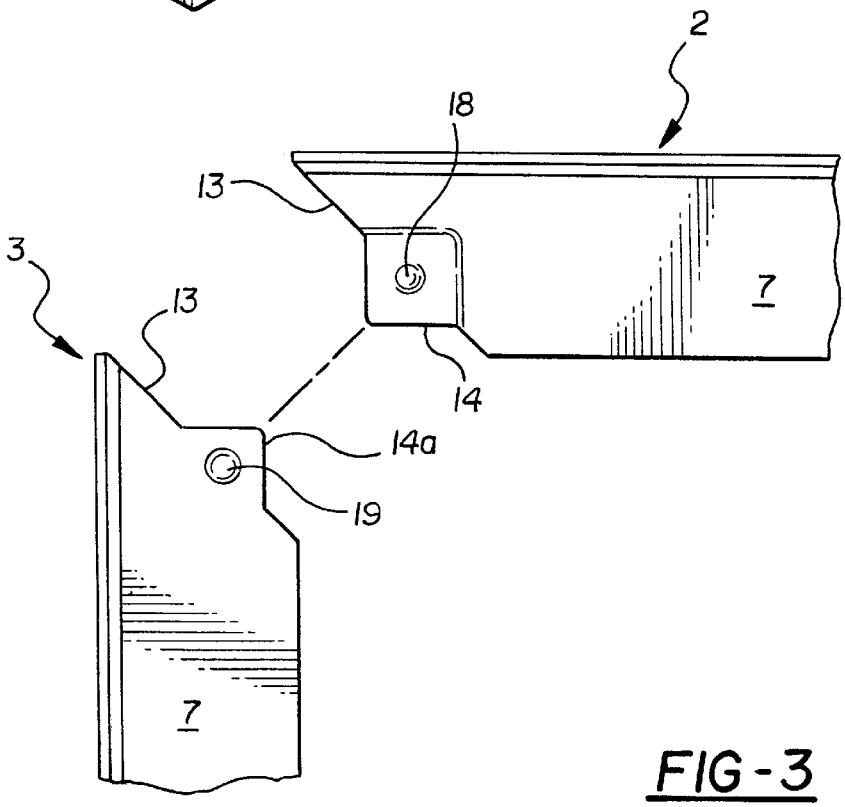
FIG. 3 is an exploded view of two of the frame members illustrating the manner in which they may be assembled.
Figure 2:
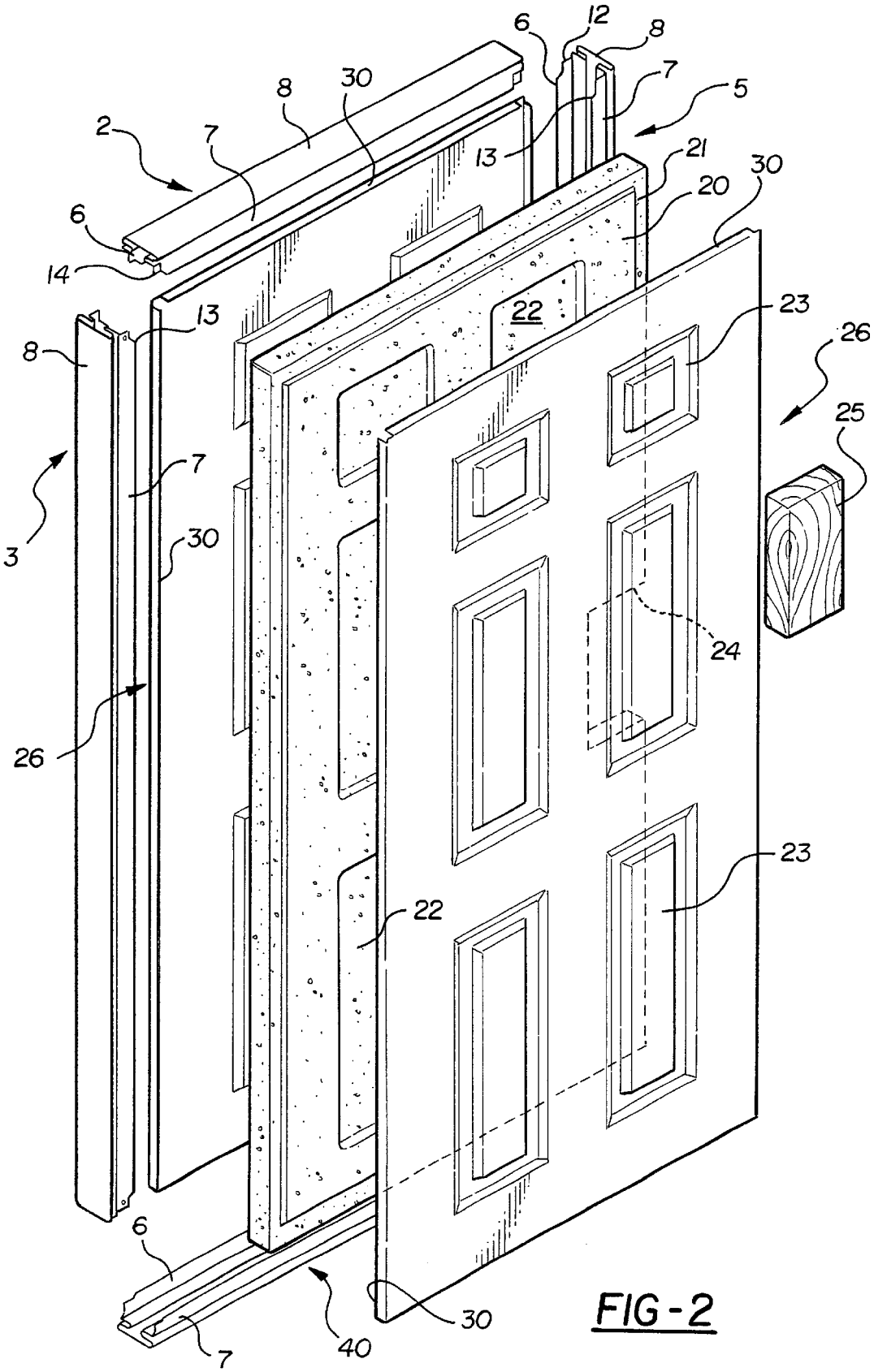
FIG. 2 is an exploded view, on an enlarged scale, of the door shown in FIG. 1.

If the finished door is to have recessed panels, as indicated at 22 in FIGS. 1 and 2, the core 20 may be molded, compressed, or indented, as shown at 23 in FIG. 2. Further, if the door is to be provided with a locking mechanism, one side of the core may be cut away to form a recess 24 (FIG. 2) in which a wood or other block 25 may be glued or otherwise suitably secured, and the block 25 may be provided with suitable openings (not shown) for the accommodation of a latch and/or bolt locking mechanism. The web 8 of the adjacent frame member 5 will have to be provided with one or more openings (not shown) to accommodate the latch and/or bolt mechanism.

The door construction is completed by the inclusion of a pair of exterior panels 26 which preferably are formed of metal sheets of such size as to span all of the frame members 2–5 when the latter are assembled. Each panel 26 may be planar, if the door is to be a flush door, or embossed to provide indentations 23 corresponding to the indentions 22 formed in the core 20. If the door is to be provided with a latch/lock mechanism 28 and a knob 29, the panels 26 may be provided with openings for the accommodation of such parts.

Each of the panels 26 has at three of its four sides a right-angular lip 30 of such thickness as to be accommodated in the groove 10 or 11 of each frame member with the core sandwiched between the panels. The inner surface of each lip bears snugly against and grips the confronting surface of the frame member. No lip is provided at that end of the panel which will be at the bottom of the door for a reason to be explained.

To assemble the components of the door the frame members 2–5 are applied to the edges of the core 20 by inserting the four edges of the core between the flanges 6 and 7 of each of the frame members. The inner surface of each of the turns 9 should seat on the associated edge 21 of the core 20. As two adjacent frame members are fitted to the core, the extensions 14 may be inserted between the extensions 14*a* so that the projections 19 are accommodated in the dimples 18.

Once the frame members have been applied to the core and coupled to one another via the coupling means 17, an adhesive coating is applied to the opposite sides of the core and to the exterior surfaces of the channel flanges 6 and 7. The panels 26 then may be applied to opposite sides of the core and the lips 30 of the panels fitted into the grooves 10 and 11 along the top and sides of the frame members. The lips 30 also may be coated with suitable adhesive so as to secure the lips within the grooves of the frame members.

The adhesive used may be any one of a number of readily available adhesives. One suitable adhesive is a polyurethane adhesive manufactured by Stabond Company of Glendena, California. Other known, appropriate adhesives may be used, if desired.

By omitting the lip 30 from the edges of the panels which are to be at the bottom of the door, either or both of the grooves 10 and 11 at the bottom of the door may be used for the accommodation of weather stripping.

Following assembly of the core, the frame members, and the exterior panels the locking mechanism 28 and the knob 29 may be applied, if desired, or the assembly of these components may be deferred until such time as the door is received by its purchaser. The same observation applies to the application of hinges, weather stripping, and any other functional or ornamental apparatus.

A door constructed in accordance with the invention may be stored and shipped independently of any framing or, if desired, the door may be assembled with appropriate framing in the manner of any so called pre-hung door.

The disclosed embodiment is representative of a presently preferred form of the invention, but is intended to be illustrative rather than definitive thereof. The invention is defined in the claims.

I claim:

1. A door construction comprising a plurality of individual frame members having mitered ends abutting one another and assembled to form a frame, each of said frame members having parallel flanges joined to and spaced by a web, each of said flanges having at its ends an extension, the extension of one of said flanges overlying the extension of the corresponding flange of the confronting frame member, the flanges being configured to form a groove at the junction of said web with each of said flanges;

a pair of panel members positioned on opposite sides of said frame, each of said panel members having a body portion spanning said frame members and terminating at a plurality of its edges in lips accommodated in said grooves; and coupling means at the abutting ends of each of said frame members coupling said frame members to one another and maintaining said frame members assembled, said coupling means being carried by said extensions.

2. The construction according to claim 1 including a core accommodated between said panel members and spanning said frame members.

3. The construction according to claim 2 including an adhesive bonding said core to said panel members.

4. The construction according to claim 2 wherein said core has its edges accommodated between the flanges of each of said frame members.

5. The construction according to claim 1 wherein said coupling means comprises projections accommodated in dimples.

6. The construction according to claim 5 including four of said frame members a first two of which correspond to one another in length and a second two of which correspond to one another in length but are longer than the first two frame members, said dimples being formed in the extensions of the first two of same frame members and said projections being formed in the extensions of the second two of said frame members.

7. The construction according to claim 5 wherein said dimples and said projections are substantially hemispherical.

8. The construction according to claim 1 wherein said frame members and said panels are metal.

9. A door construction comprising a first pair of individual uniform length frame members;

a second pair of individual uniform length frame members, the length of the frame members of said first pair being less than the length of the frame members of said second pair, opposite ends of each of said first pair of frame members confronting and being assembled with opposite ends of each of said second pair of frame members, thereby forming a rectangular frame;

cooperable coupling means at opposite ends of each of said frame members and engaging one another for maintaining all of said frame members assembled, each of said frame members having a pair of spaced, parallel flanges joined by a web, each of the flanges of each of said frame members having an extension extending beyond said flange, said coupling means being carried by said extensions, the juncture of said web with each of said flanges forming a groove; and a pair of spaced apart, parallel panels each of which spans all of said frame members on opposite sides of said frame, each of said panels terminating at selected ones of its edges in lips accommodated in said grooves.

10. The construction according to claim 9 wherein each end of each of said frame members is formed on an angle such that confronting ends of adjacent frame members are substantially normal to one another.

11. The construction according to claim 9 wherein said coupling means comprises a dimple in one of said extensions and a projection on the other of said extensions.

12. The construction according to claim 11 wherein said dimple and said projection nest.

13. The construction according to claim 11 wherein said dimple and said projection are substantially hemispherical.

14. The construction according to claim 9 including a core interposed between said panels and substantially spanning the space between all of said frame members.

15. The construction according to claim 14 wherein said panels are adhesively bonded to said core.

16. A door construction comprising a plurality of individual frame members joined to one another and forming a quadrangular frame, each of said frame members having a pair of parallel flanges joined to and spaced apart by a web, the flanges of adjacent ones of said frame members having mitered ends abutting one another, each of said flanges having an extension projecting beyond its mitered end, the extensions at the abutting ends of adjacent ones of said flanges overlapping one another;

cooperable coupling means carried by said extensions and securing said frame members to one another;

a quadrangular core member having an area corresponding substantially to that of said frame with its marginal edges accommodated between the flanges of said frame members;

a pair of panel members, each of said panel members having a body portion overlying said core member and spanning all of said frame members; and means securing said panel members to said frame members on opposite sides of said frame.

17. The door construction according to claim 16 wherein said coupling means comprises a dimple in one of each of said extensions and a projection in each of the other of said extensions, the dimples and projections of said overlapping extension nesting with one another.

* * * * *